United States Patent [19]

Provolo et al.

[11] Patent Number: 4,727,240

[45] Date of Patent: Feb. 23, 1988

[54] ELECTRIC IRON WITH DUAL AUTOMATIC CUTOFF

[75] Inventors: Daniel J. Provolo; Peter A. Czerner, both of Trumbull; Michael Singleton, Bridgeport; Roman Czernik, Trumbull, all of Conn.

[73] Assignee: Black & Decker Inc., Newark, Del.

[21] Appl. No.: 895,277

[22] Filed: Aug. 11, 1986

[51] Int. Cl.[4] ..... H05B 1/02; D06F 75/26

[52] U.S. Cl. ..... 219/250; 219/257; 219/493; 219/492; 200/61.52; 38/82; 340/655; 340/815.03

[58] Field of Search ..... 219/250, 251, 252, 257, 219/493, 492, 507–509; 200/61.52; 38/82; 340/635, 655, 588, 686, 815.03

[56] References Cited

U.S. PATENT DOCUMENTS

| | | | |
|---|---|---|---|
| 4,203,101 | 5/1980 | Towsend | 219/250 |
| 4,520,257 | 5/1985 | Schwob et al. | 219/250 |
| 4,580,038 | 4/1986 | O'Loughlin | 219/252 |

FOREIGN PATENT DOCUMENTS

| | | | |
|---|---|---|---|
| 1031199 | 2/1986 | Japan | 219/250 |
| 2158105 | 11/1985 | United Kingdom | 219/250 |

*Primary Examiner*—M. H. Paschall

*Attorney, Agent, or Firm*—Paul J. Lerner

[57] ABSTRACT

An automatic-cutoff electric iron employs two timing cycles for turning off power to the electric iron upon the absence of motion for two different discrete time periods. A motion sensor includes an angle sensor to enable a short timing cycle for cutting off power to the electric iron after the electric iron is motionless with its sole plate in a horizontal orientation. The longer timing cycle is enabled when the electric iron is motionless with its sole plate tilted from the horizontal. The cutoff function is performed by a wedge-shaped actuator driven by a solenoid which releases a spring-urged shaft along with one of the electrical contacts feeding power to the electric iron. The power is turned on by mechanical actuation of the shaft whereby a latch member is engaged behind a cam boss. A manual cutoff is also disclosed.

2 Claims, 5 Drawing Figures

ELECTRIC IRON WITH DUAL AUTOMATIC CUTOFF

BACKGROUND OF THE INVENTION

The present invention relates to electric appliances and, more specifically, to electric irons.

An electric iron consists essentially of a heating element and a means for controlling the application of electric power to the heating element. Thermostatic controls are conventionally employed to maintain a sole-plate temperature in a selectable range.

One of the long-felt problems of electric irons is a perceived danger of fire or injury resulting from an electric iron inadvertently being left energized for an extended period. One solution to this problem, disclosed in U.S. patent application Ser. Nos. 687,842 and 678,843, includes a timer and a motion sensor connected to cut off electric power to the heating element if the electric iron remains stationary for a predetermined period such as, for example, about 10 minutes.

Although the 10-minute cutoff cycle is appropriate for avoiding long-term operation of an electric iron in the absence of motion, if the soleplate of an electric iron remains stationary in contact with a fabric, or other material susceptible to heat damage, marking, charring, or other damage may occur long before the expiration of the 10-minute timing period. Reducing the timing period to a short enough value to avoid such damage interferes with normal usage of the electric iron which may be rested on its heel for several minutes while other tasks are undertaken by the operator.

The electronic and electro-mechanical components for operating an electric iron are conventionally contained in a hollow handle and a hollow forward pedestal. Modern styling of electric irons tends toward narrower and more angled designs, thereby reducing the amount of space available for the electronic and electromechanical components. Thus, more compact elements are desireable. Furthermore, it is desireable to reduce the manufacturing cost of such elements. One area of present interest for size and cost reduction is a relay switch used for breaking the power to the electric iron if the timer reaches the end of its cycle without being reset by the motion sensor.

OBJECTS AND SUMMARY OF THE INVENTION

It is an object of the invention to provide an electric iron which overcomes the drawbacks of the prior art.

It is a further object of the invention to provide an electric iron having first and second timing cycles. A first timing cycle turns off power to the heating element of the electric iron unless reset by motion of the electric iron before the end of a first time period. A second timing cycle, shorter than the first time period, turns off power to the heating element of the electric iron unless reset by motion of the electric iron. The second timing cycle is effective when the soleplate of the electric iron is in a horizontal position.

It is a further object of the invention to provide a solenoid actuator for turning off power to an electric iron in response to a signal representing an end of a timing cycle.

It is a still further object of the invention to provide a solenoid actuator for an electric iron having a wedge-shaped actuator driven by a solenoid for unlatching a switch feeding power to the electric iron.

Briefly stated, the present invention provides an automatic-cutoff electric iron employing two timing cycles for turning off power to the electric iron upon the absence of motion for two different discrete time periods. A motion sensor includes an angle sensor to enable a short timing cycle for cutting of power to the electric iron after the electric iron is motionless with its sole plate in a horizontal orientation. The longer timing cycle is enabled when the electric iron is motionless with its sole plate tilted from the horizontal. The cutoff function is performed by a wedge-shaped actuator driven by a solenoid which releases a spring-urged shaft along with one of the electrical contacts feeding power to the electric iron. The power is turned on by mechanical actuation of the shaft whereby a latch member is engaged behind a cam boss on the shaft. A manual cutoff is also disclosed.

According to an embodiment of the invention, there is provided a dual-cutoff electric iron comprising: a heating element, a sole plate heatable by the heating element, mechanically actuatable means for feeding electric power to the heating element, means for producing first and second timing signals, the first timing signal having a first timing period, the second timing signal having a second timing period, the first timing period being substantially shorter than the second timing period, a motion sensor, the motion sensor including means for producing a change in an output thereof in response to motion of the electric iron, the means for producing including means responsive to the change for resetting without producing the first and second timing signals, the motion sensor having means for producing a first quiescent output responsive to the electric iron being motionless with its sole plate in a generally horizontal orientation and for producing a second quiescent output responsive to the electric iron being motionless with its sole plate in an orientation other than generally horizontal, means responsive to the second timing signal for electrically opening the mechanically actuatable means, whereby power to at least the heating element is cut off, and means responsive to the first quiescent output for enabling the means for electrically opening to be responsive to the first timing signal for electrically opening the mechanically actuatable means, whereby different cutoff times are achieved in response to the first and second quiescent outputs.

According to a feature of the invention, there is provided a switching device comprising: a stationary electrical contact, a movable electrical contact, a shaft, means on the shaft for manually urging the movable electrical contact into electrical engagement with the stationary electrical contact, first resilient means for urging the movable electrical contact away from the stationary electrical contact, a latch member, second resilient means for urging the latch member toward the shaft, means on the shaft for camming engagement with the latch member whereby the latch member is movable against the urging of the second resilient means, the means on the shaft and the latch member further including stable engagement means engageable for retaining the shaft in a position wherein the movable electrical contact is in electrical contact with the stationary electrical contact, an electrical solenoid having an armature, an actuator head connected to the armature, the actuator head having a first inclined cam surface, a hole in the latch member, a second inclined cam surface in the hole having an angle substantially matching an angle of the first inclined surface, and the first and second inclined surfaces being effective, when the solenoid is energized, for moving the latch member out of the position whereby the shaft and the movable contact are movable by the resilient means to positions breaking the electrical contact.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
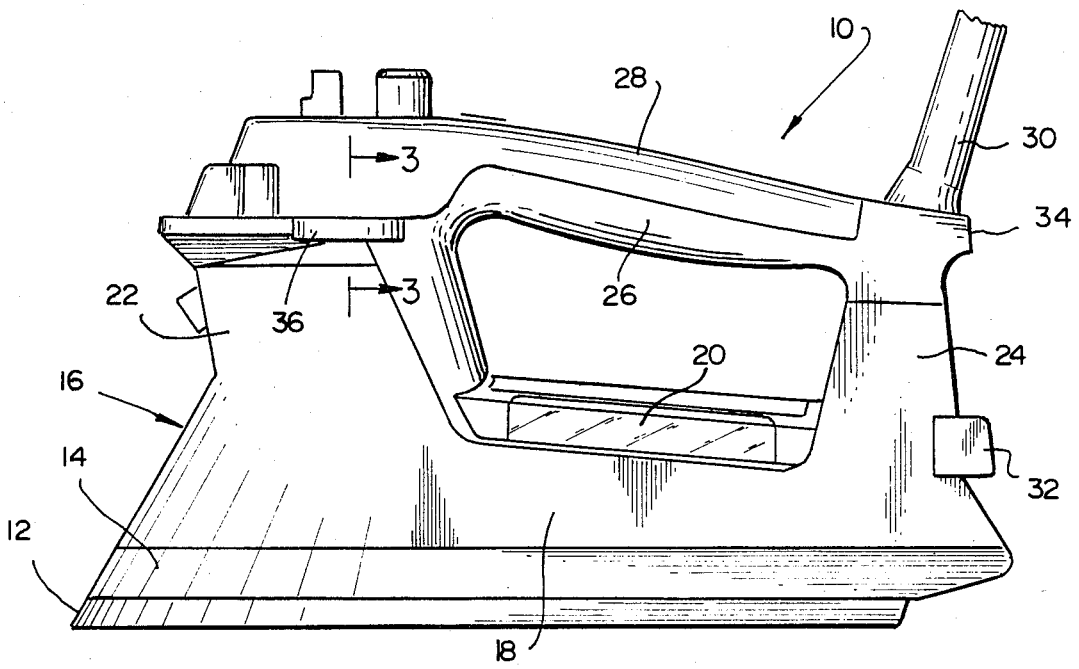
FIG. 1 is a side view of an electric iron to which the present invention may be applied.

Referring to FIG. 1, an electric iron is shown, generally at 10. A metallic sole plate 12 is heated by an electric heater element (not shown in FIG. 1). A heat barrier 14, preferably of a heat-resistant material such as, for example, phenolic, is disposed above metallic sole plate 12. A housing 16, preferably of a thermoplastic material such as, for example, polypropylene, is disposed atop heat barrier 14.

Housing 16 includes a body 18 which may contain the heating element and a water reservoir (not shown) suitable for containing water whose level is discernible through a transparent sight gauge 20. A forward pedestal 22 rises near the front of housing 16 and a rear pedestal 24 rises near the rear of housing 16. A handle lower shell 26 joins facing portions of forward pedestal 22 and rear pedestal 24. A handle upper shell and control cover 28 closes the top of handle lower shell 26 and forward pedestal 22. An electric cord 30, entering through rear pedestal 24, provides electric power to interior components of electric iron 10. A conventional heel plate 32 and a heel rest 34 are disposed at the rear end of electric iron 10. As is conventional, electric iron 10 may be rested on a horizontal surface upon heel plate 32 and heel rest 34 with metallic sole plate 12 inclined at a substantial upward angle out of contact with the horizontal surface.

Handle lower shell 26 and handle upper shell and control cover 28, as well as forward pedestal 22, are hollow whereby space is provided for mechanical actuators, control valves, electronics and electro-mechanical devices required for operation of electric iron 10. An ON pushbutton 36 is disposed above forward pedestal 22. Other conventional controls are visible in FIG. 1 but are not identified or described since they are not considered to form an inventive part of the present disclosure.

Figure 2:
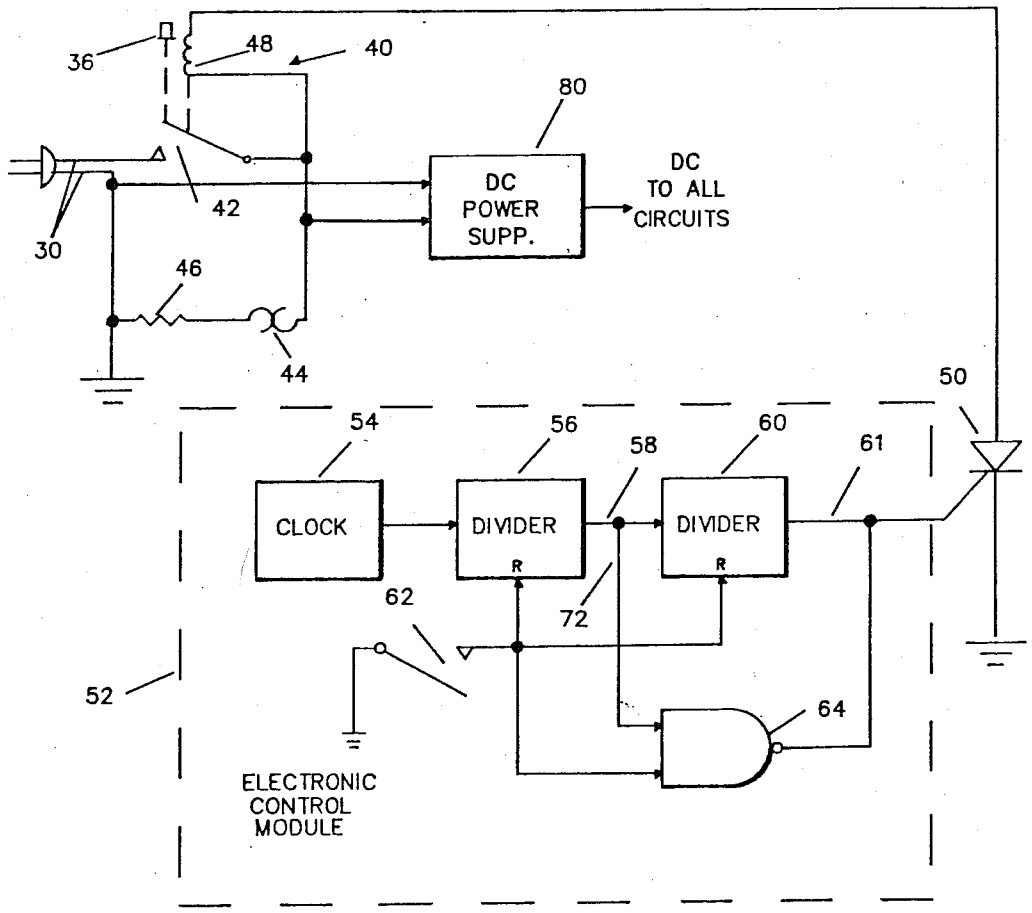
FIG. 2 is a block and schematic diagram of an electrical control system according to an embodiment of the invention.

Referring now to FIG. 2, there is shown, generally at 38, an electrical control system according to an embodiment of the invention. A manually actuated, electrically deactuated switch 40 includes a switch 42 in series between one conductor of electric cord 30 and a thermostatic switch 44. A heater element 46 is connected between thermostatic switch 44 and the other conductor of electric cord 30. Switch 42 is manually closeable by actuation of ON pushbutton 36, and remains closed in a manner to be described, until released by actuation of a solenoid 48.

One terminal of solenoid 48 is connected to the switched side of switch 42. The other terminal of solenoid 48 is connected to an anode terminal of a power-switching device 50 such as, for example, a silicon-controlled rectifier, a power transistor, or a disk. For purposes of description, power-switching device 50 is assumed to be a silicon-controlled rectifier. One skilled in the art, with access to the present disclosure would be fully enabled to substitute alternative devices, such as those listed above, as well as others not listed.

A cathode terminal of power-switching device 50 is connected to ground. As is well known, a silicon-controlled rectifier remains in a non-conducting condition until a gate terminal thereof is given a voltage more positive than its anode terminal. Once the gate terminal is made more positive than the anode terminal, the silicon-controlled rectifier is driven into full conduction, regardless of subsequent changes in the gate voltage. Conduction continues in the silicon-controlled rectifier until the anode terminal becomes more negative than the cathode terminal.

An electronic control module 52 includes means for generating two timing cycles and an enable circuit for enabling the shorter of the two timing cycles to trigger the gate electrode of power-switching device 50 under predetermined conditions. A clock generator 54 produces a clock signal which may be at any convenient substantially constant frequency. The clock frequency is applied to a first divider 56 where it is counted down to a first timer frequency of any convenient value such as, for example, 0.03 Hz (one cycle per 30 seconds). The first timer frequency is connected on a line 58 to an input of a second divider 60 wherein the frequency is divided by a second value to produce a second timer frequency of a second convenient value such as, about one cycle per 10 minutes. An output of second divider 60 is connected on a line 61 to the gate electrode of power-switching device 50.

A motion and angle sensor 62 is connected between ground and reset terminals R of both first divider 56 and second divider 60. Whenever motion and angle sensor 62 is closed, first divider 56 and second divider 60 are reset, whereupon these circuits begin counting toward the end of their timing periods. Motion and angle sensor 62 includes a first quiescent condition in which it is closed when electric iron 10 rests without motion upon its metallic sole plate 12. Motion and angle sensor 62 includes a second quiescent condition in which it opens when electric iron 10 rests without motion upon its heel plate 32 and heel rest 34. Motion and angle sensor 62 may be of any convenient type, but is preferably a conventional mercury switch oriented so that its contacts are closed when electric iron 10 is in a position placing its metallic sole plate 12 in a horizontal position. Motion of electric iron 10 in any angular orientation thereof is effective for periodically opening motion and angle sensor 62, whereby first divider 56 and second divider 60 are continuously reset before the ends of their timing periods.

A short-cycle enable circuit 64 includes a transistor 66 having its base connected to motion and angle sensor 62 through a resistor 68 and a diode 70. The first timer frequency on line 58 is connected on a line 72 to one terminal of a resistor 74. The other terminal of resistor 74 is connected to an emitter terminal of transistor 66. A collector terminal of transistor 66 is connected to the gate terminal of power-switching device 50. A resistor 76 and a capacitor 78 are connected in parallel between the emitter and base terminals of transistor 66.

With motion and angle sensor 62 open, as occurs with electric iron 10 resting stationary on heel plate 32 and heel rest 34, the base of transistor 66 essentially floats. Thus, the emitter-collector path of transistor 66 remains non-conducting. Changes in the condition of the first timing signal applied to the emitter of transistor 66 has no effect on the collector terminal thereof. Thus, the first timing signal is inhibited from triggering power-switching device 50. If electric iron 10 remains stationary in the sole-up condition until the end of the second timing cycle, a resulting positive signal applied from second divider 60 on motion and angle sensor 62 to the gate terminal of power-switching device 50 triggers power-switching device 50 into full conduction on its anode-cathode path. This draws a heavy current through solenoid 48, thereby actuating switch 42 in the opening direction. When switch 42 is thus opened, all power to electric iron 10 is cut off and remains in this condition until power is reapplied by manual actuation of ON pushbutton 36.

Although discrete components may be employed for achieving clock generator 54, first divider 56 and second divider 60, it is contemplated that integrated circuits are preferable. Separate integrated circuits are not required. For example, a conventional integrated-circuit timer may take the place of clock generator 54 and first divider 56. Alternatively, all functions of clock generator 54, first divider 56 and second divider 60 may be performed by a single integrated circuit such as, for example, an integrated circuit type CD4060B, commercially available at the time of filing the present application from the Radio Corporation of America (RCA). Such a single integrated circuit requires only the connection of conventional external passive timing components to control its operation.

A conventional DC power supply 80 provides DC power to all elements in electrical control system 38 requiring it.

Figure 3:
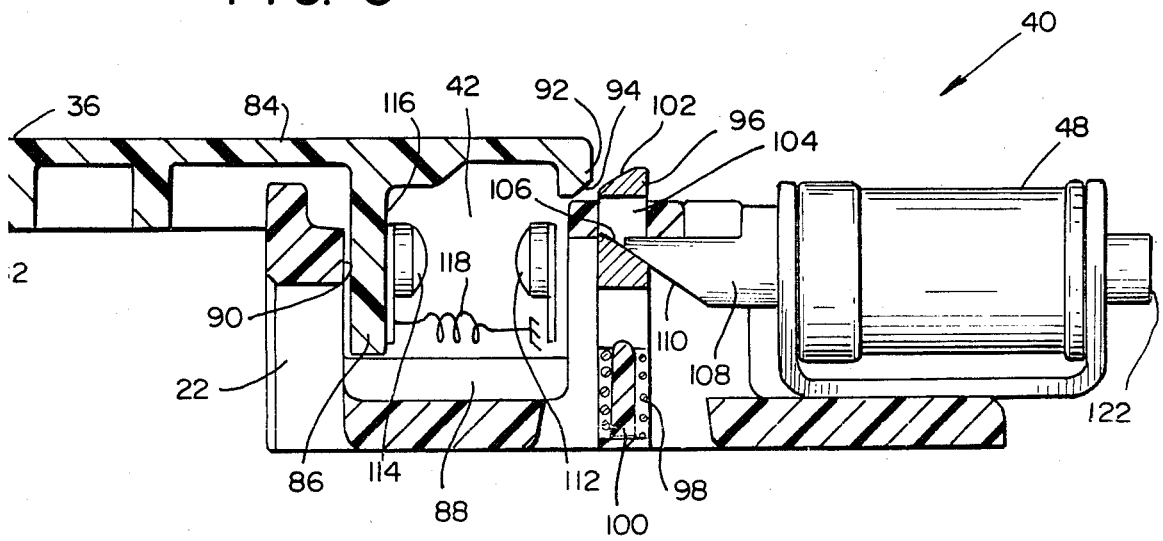
FIG. 3 is a partial cross section taken along III—III in FIG. 1, showing a manually actuated, electrically deactuated switch in its deactuated condition.

Referring now to FIG. 3, ON pushbutton 36 includes an operating surface 82 suitable for actuation by an operator to energize electric iron 10. A shaft 84 includes a dependent boss 86 extending at right angles thereto. Forward pedestal 22 includes a rectangular crevice 88 therein having a forward abutment surface 90 therein effective for limiting forward (leftward) motion of dependent boss 86, and consequently, of ON pushbutton 36. A dependent cam boss 92, at the rear of ON pushbutton 36, includes an inclined cam surface 94 thereon. A slidable latch member 96 is guided for vertical motion under the urging of a coil spring 98. Coil spring 98 is stabilized by a guide post 100. An upper end of latch member 96 includes an inclined cam surface 102 having an angle generally matching an angle of inclined cam surface 94. A hole 104 in latch member 96 includes an inclined cam surface 106.

Solenoid 48 includes an actuator head 108 disposed on an armature shaft (not shown in FIG. 3). An inclined cam surface 110 on actuator head 108, having a cam angle substantially matching the cam angle of inclined cam surface 106, fits within hole 104.

Stationary electrical contact 112 of switch 42 (FIG. 2) is disposed in rectangular crevice 88 at a position remote from forward abutment surface 90. A movable electrical contact 114 of switch 42 is urged against an inner surface 116 of dependent boss 86 by resilient means such as, for example, a spring 118. Although not so illustrated, spring 118 may be replaced with a resilient flat spring supporting movable electrical contact 114.

Figure 4:
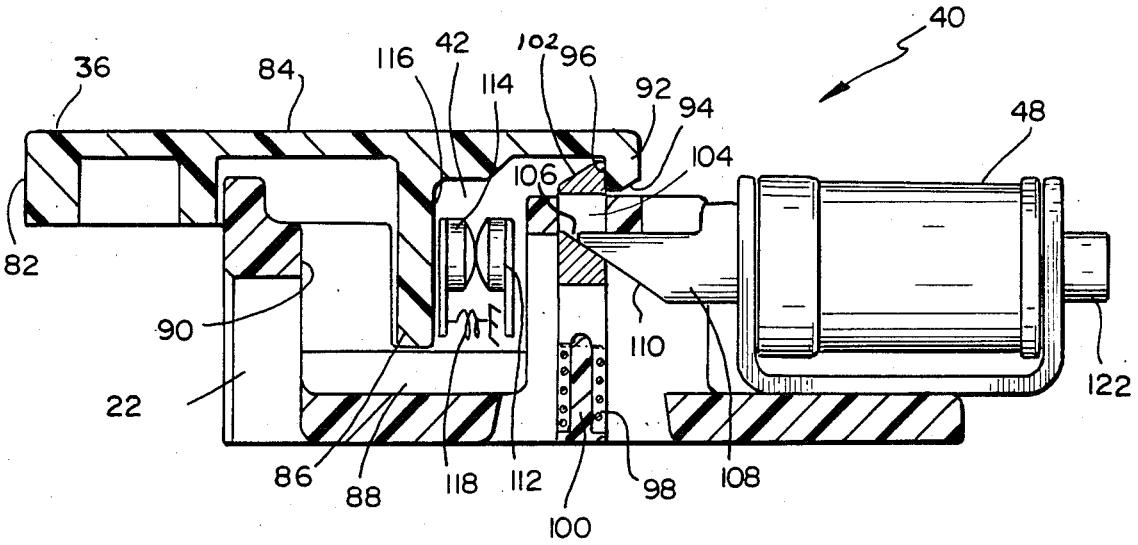
FIG. 4 is a partial cross section corresponding to FIG. 3 in the engaged condition with its electrical contacts stably engaged.

In order to energize electric iron 10, ON pushbutton 36 is pushed rightward in the FIG. 3. Inclined cam surface 94 slides onto inclined cam surface 102 whereby latch member 96 is moved downward against the urging of spring 118. Sufficient free space is available in hole 104 above inclined cam surface 110 to permit downward motion of latch member 96 until dependent cam boss 92 passes beyond latch member 96, whereupon coil spring 98 urges latch member 96 upward into the locking position as shown in FIG. 4. In this position, stationary electrical contact 112 and movable electrical contact 114 are held in firm electrical contact.

Figure 5:
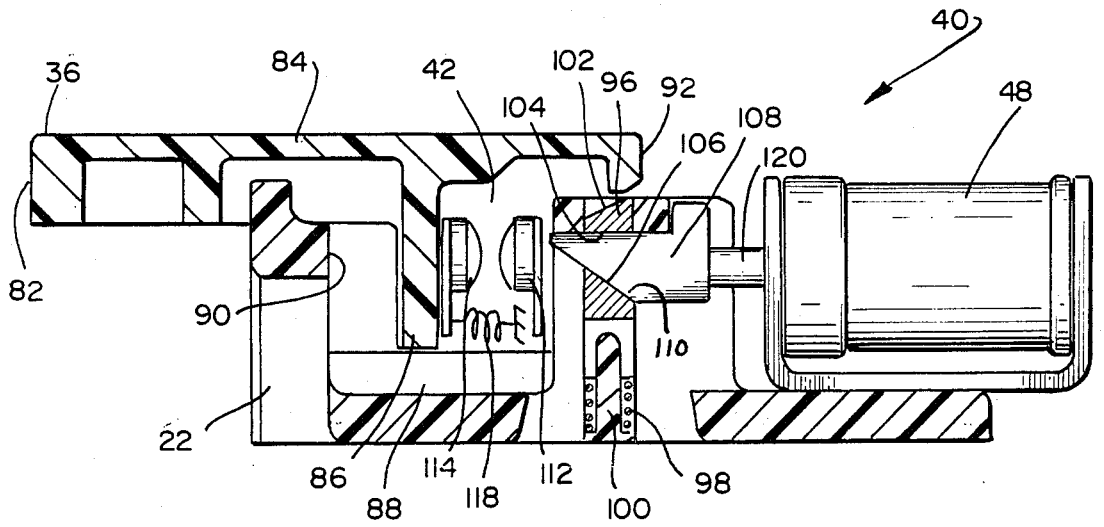
FIG. 5 is a cross section corresponding to FIGS. 3 and 4 with the manually actuated, electrically deactuated switch in the process of opening its electrical contacts.

Referring now to FIG. 5, manually actuated, electrically deactuated switch 40 and switch 42 are shown in the process of disconnection. A shaft 120 of solenoid 48 urges actuator head 108 into hole 104, whereby inclined cam surface 110 slides over inclined cam surface 106, driving latch member 96 downward against the urging of coil spring 98. Latch member 96 releases dependent cam boss 92, thereby permitting shaft 84 to move leftward under the urging of spring 118. Stationary electrical contact 112 and movable electrical contact 114 break contact. This de-energizes all items in electric iron 10, including solenoid 48. Shaft 120 and actuator head 108 return to their rightward positions while shaft 84 and movable electrical contact 114 continue to their inoperative positions shown in FIG. 3.

Referring again to FIGS. 2–5, one embodiment of the invention provides for de-activation of electric iron 10 only through the action of manually actuated, electrically deactuated switch 40 and switch 42. That is, once switch 42 is closed, it remains in the condition shown in FIG. 4 until opened by energization of solenoid 48 in the manner described in the foregoing. In a further embodiment of the invention, a mechanical OFF control 122 is provided which may be manually pressed to move actuator head 108 into the unlatching position shown in FIG. 5. Mechanical OFF control 122 may be, for example, the end of the armature of solenoid 48, or an extension thereof.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A switching device comprising:

a stationary electrical contact;

a movable electrical contact;

a shaft;

means on said shaft for manually urging said movable electrical contact into electrical engagement with said stationary electrical contact;

first resilient means for urging said movable electrical contact away from said stationary electrical contact;

a latch member;

second resilient means for urging said latch member toward said shaft;

means on said shaft for camming engagement with said latch member whereby said latch member is movable against the urging of said second resilient means;

said means on said shaft and said latch member further including stable engagement means engageable for retaining said shaft in a position wherein said movable electrical contact is in electrical contact with said stationary electrical contact;

an electrical solenoid having an armature;

an actuator head connected to said armature;

said actuator head having a first inclined cam surface;

a hole in said latch member;

a second inclined cam surface in said hole having an angle substantially matching an angle of said first inclined surface; and said first and second inclined surfaces being effective, when said electrical solenoid is energized, for moving said latch member out of said position whereby said shaft and said movable contact are movable by said resilient means to positions breaking said electrical contact.

2. A switching device according to claim 1, further comprising manual means for urging said actuator into unlocking engagement with said latch member whereby said electrical contact is breakable without energization of said electrical solenoid.

* * * * *